US010696520B2

(12) United States Patent
Aiba

(10) Patent No.: US 10,696,520 B2
(45) Date of Patent: Jun. 30, 2020

(54) ELEVATOR SYSTEM

(71) Applicant: Mitsubishi Electric Corporation, Chiyoda-ku (JP)

(72) Inventor: Junichi Aiba, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 490 days.

(21) Appl. No.: 15/570,931

(22) PCT Filed: Jun. 8, 2016

(86) PCT No.: PCT/JP2016/067040
§ 371 (c)(1),
(2) Date: Oct. 31, 2017

(87) PCT Pub. No.: WO2016/208394
PCT Pub. Date: Dec. 29, 2016

(65) Prior Publication Data

US 2018/0290860 A1 Oct. 11, 2018

(30) Foreign Application Priority Data

Jun. 25, 2015 (JP) ..... 2015-127385

(51) Int. Cl.
*B66B 5/02* (2006.01)
*B66B 5/00* (2006.01)
*B66B 1/28* (2006.01)

(52) U.S. Cl.
CPC ..... *B66B 5/022* (2013.01); *B66B 1/28* (2013.01); *B66B 5/0087* (2013.01); *B66B 2201/402* (2013.01)

(58) Field of Classification Search
CPC ..... B66B 5/022; B66B 5/0087; B66B 1/28; B66B 2201/404

(Continued)

(56) References Cited

U.S. PATENT DOCUMENTS 4,382,489 A * 5/1983 Suzuki ..... B66B 5/022 187/278
4,809,817 A * 3/1989 Kawai ..... B66B 5/022 187/278

(Continued)

FOREIGN PATENT DOCUMENTS

JP 2009-126686 A 6/2009

OTHER PUBLICATIONS

International Preliminary Report on Patentability and Written Opinion dated Jan. 4, 2018 in PCT/JP2016/067040.

(Continued)

*Primary Examiner* — David S Warren
(74) *Attorney, Agent, or Firm* — Oblon, McClelland, Maier & Neustadt, L.L.P.

(57) ABSTRACT

An elevator system includes a first car, a diagnosis operation control unit (12), a learning operation control unit (13), a setting unit (14), a second car, and an operation control unit (10). The diagnosis operation control unit (12) moves, after an occurrence of an earthquake, the first car to perform a diagnosis operation. The learning operation control unit (13) moves the first car to perform a learning operation. The setting unit (14) sets a reference range for detecting an abnormality in the diagnosis operation on the basis of learning data acquired in the learning operation. The operation control unit (10) controls a position of the second car so as not to be positioned at the same height as the first car when the learning operation is performed by the learning operation control unit (13).

10 Claims, 10 Drawing Sheets

(58) Field of Classification Search
USPC ..... 187/247
See application file for complete search history.

(56) References Cited

U.S. PATENT DOCUMENTS

| | | | | |
|---|---|---|---|---|
| 4,998,601 | A * | 3/1991 | Suzuki | B66B 5/022 187/278 |
| 10,625,980 | B2 * | 4/2020 | Matsueda | B66B 1/3423 |
| 2010/0213013 | A1 * | 8/2010 | Urata | B66B 5/022 187/278 |
| 2018/0290860 | A1 * | 10/2018 | Aiba | B66B 1/28 |
| 2020/0126549 | A1 * | 4/2020 | Tei | F24F 11/49 |

OTHER PUBLICATIONS

International Search Report dated Aug. 30, 2016 in PCT/JP2016/067040, filed on Jun. 8, 2016.

* cited by examiner

NO. 2: OPERATION INSTRUCTION UNIT
NO. 3: CAR POSITION DETECTING UNIT

NO. 9 : STORAGE UNIT
NO. 10: OPERATION CONTROL UNIT
NO. 11: EMERGENCY OPERATION CONTROL UNIT
NO. 12: DIAGNOSIS OPERATION CONTROL UNIT
NO. 13: LEARNING OPERATION CONTROL UNIT
NO. 14: SETTING UNIT

S101: HAS EARTHQUAKE OCCURRED?
S102: EARTHQUAKE EMERGENCY OPERATION
S103: DIAGNOSIS OPERATION
S104: IS ABNORMALITY DETECTED?
S105: STOP DIAGNOSIS OPERATION
S106: AUTOMATICALLY RECOVER TO NORMAL OPERATION

S201: IS START CONDITION SATISFIED?
S202: START LEARNING OPERATION
S203: IS LEARNING OPERATION COMPLETED?
S204: STORE LEARNING DATA
S205: SET REFERENCE RANGE

S301: IS START CONDITION SATISFIED IN ADJACENT ELEVATOR APPARATUS?
S302: CONTROL CAR POSITION SO AS NOT TO BE POSITIONED AT SAME HEIGHT AS CAR WHICH IS PERFORMING LEARNING OPERATION
S303: IS LEARNING OPERATION COMPLETED IN ADJACENT ELEVATOR APPARATUS?

S401: IS START CONDITION SATISFIED IN ADJACENT ELEVATOR APPARATUS?
S402: STOP CAR WHEN CAR IS POSITIONED AT SAME HEIGHT AS CAR WHICH IS PERFORMING LEARNING OPERATION
S403: IS LEARNING OPERATION COMPLETED IN ADJACENT ELEVATOR APPARATUS?

NO. 16: INPUT/OUTPUT INTERFACE
NO. 17: PROCESSOR
NO. 18: MEMORY

ELEVATOR SYSTEM

FIELD

The present invention relates to an elevator system.

BACKGROUND

PTL 1 discloses an elevator apparatus that performs a diagnosis operation after an occurrence of an earthquake. The diagnosis operation is performed to cause an elevator apparatus which has stopped due to an earthquake to automatically recover to a normal operation. In the diagnosis operation, predetermined various motions are performed. When all the motions are completed without detecting any abnormality, the elevator apparatus can be recovered to the normal operation.

CITATION LIST

Patent Literature

[PTL 1] JP 2009-126686 A

SUMMARY

Technical Problem

In the diagnosis operation, various pieces of data are measured. For example, torque data about a traction machine is measured. If data measured in the diagnosis operation is out of a reference range, an abnormality is detected. The reference range used in the diagnosis operation is set on the basis of, for example, learning data acquired in a learning operation. For example, a certain range in which the learning data acquired in the learning operation is used as a central value is set as the reference range.

FIG. 13 is a diagram for explaining a problem with the related art. FIG. 13 illustrates learning data acquired in a learning operation and a reference range set on the basis of the learning data. A range between an upper limit and a lower limit as illustrated in FIG. 13 corresponds to the reference range. When the learning data includes a local variation as indicated by D in FIG. 13, an abnormality is detected in the diagnosis operation, even if an abnormality has not actually occurred. As a result of research, the applicant has found that when an adjacent car which is performing a normal operation goes by or overtakes a car which is performing a learning operation, the local variation as indicated by D in FIG. 13 occurs due to the wind pressure.

The present invention is made in order to solve the above-mentioned problem. An object of the present invention is to provide an elevator system capable of appropriately setting a reference range for detecting an abnormality in a diagnosis operation.

Solution to Problem

An elevator system of the present invention comprises a first car that moves vertically, diagnosis operation control means for moving, after an occurrence of an earthquake, the first car to perform a diagnosis operation, learning operation control means for moving the first car to perform a learning operation, setting means for setting a reference range for detecting an abnormality in the diagnosis operation on the basis of learning data acquired in the learning operation, a second car that moves vertically and is allowed to be positioned so as to be adjacent to the first car at the same height as the first car, and operation control means for controlling a position of the second car so as not to be positioned at the same height as the first car during the learning operation performed by the learning operation control means.

An elevator system of the present invention comprises a first car that moves vertically, diagnosis operation control means for moving, after an occurrence of an earthquake, the first car to perform a diagnosis operation, learning operation control means for moving the first car to perform a learning operation, setting means for setting a reference range for detecting an abnormality in the diagnosis operation on the basis of learning data acquired in the learning operation, a second car that moves vertically and is allowed to be positioned so as to be adjacent to the first car at the same height as the first car, and operation control means for causing the second car to stop when the second car is positioned at the same height as the first car during the learning operation performed by the learning operation control means.

An elevator system of the present invention comprises a first car that moves vertically, diagnosis operation control means for moving, after an occurrence of an earthquake, the first car to perform a diagnosis operation, learning operation control means for moving the first car to perform a learning operation, setting means for setting a reference range for detecting an abnormality in the diagnosis operation on the basis of learning data acquired in the learning operation, a second car that moves vertically and is allowed to be positioned so as to be adjacent to the first at the same height as the first car, and operation control means for moving the second car at a first speed to perform a normal operation. The operation control means causes, during the learning operation performed by the learning operation control means, the second car to be moved at a second speed when the second car being moved is positioned at the same height as the first car. The second speed is lower than the first speed.

An elevator system of the present invention comprises a first car that moves vertically, diagnosis operation control means for moving, after an occurrence of an earthquake, the first car to perform a diagnosis operation, learning operation control means for moving the first car to perform a learning operation, setting means for setting a reference range for detecting an abnormality in the diagnosis operation on the basis of learning data acquired in the learning operation, and a second car that moves vertically and is allowed to be positioned so as to be adjacent to the first car at the same height as the first car. The learning operation control means stops the learning operation when the second car is positioned at the same height as the first car during the learning operation.

An elevator system of the present invention comprises a first car that moves vertically, diagnosis operation control means for moving, after an occurrence of an earthquake, the first car to perform a diagnosis operation, learning operation control means for moving the first car to perform a learning operation, setting means for setting a reference range for detecting an abnormality in the diagnosis operation on the basis of learning data acquired in the learning operation, and a second car that moves vertically and is allowed to be positioned so as to be adjacent to the first car at the same height as the first car. The learning operation control means stops the learning operation when the second car being moved is positioned at the same height as the first car during the learning operation.

An elevator system of the present invention comprises a first car that moves vertically, diagnosis operation control a weans for moving, after an occurrence of an earthquake, the first car to perform a diagnosis operation, learning operation control means for moving the first car to perform a learning operation, setting means for setting a reference range for detecting an abnormality in the diagnosis operation on the basis of learning data acquired in the learning operation, and a second car that moves vertically and is allowed to be positioned so as to be adjacent to the first car at the same height as the first car. The setting means sets the reference range without using learning data acquired when the second car is positioned at the same height as the first car among the learning data acquired in the learning operation.

An elevator system of the present invention comprises a first car that moves vertically, diagnosis operation control means for moving, after an occurrence of an earthquake, the first car to perform a diagnosis operation, learning operation control means for moving the first car to perform a learning operation, setting means for setting a reference range for detecting an abnormality in the diagnosis operation on the basis of learning data acquired in the learning operation, and a second car that moves vertically and is allowed to be positioned so as to be adjacent to the first car at the same height as the first car. The setting means sets the reference range without using learning data acquired when the second car being moved is positioned at the same height as the first car among the learning data acquired in the learning operation.

Advantageous Effects of Invention

An elevator system according to the present invention can appropriately set a reference range for detecting an abnormality in a diagnosis operation.

DESCRIPTION of EMBODIMENTS

Figure 1:
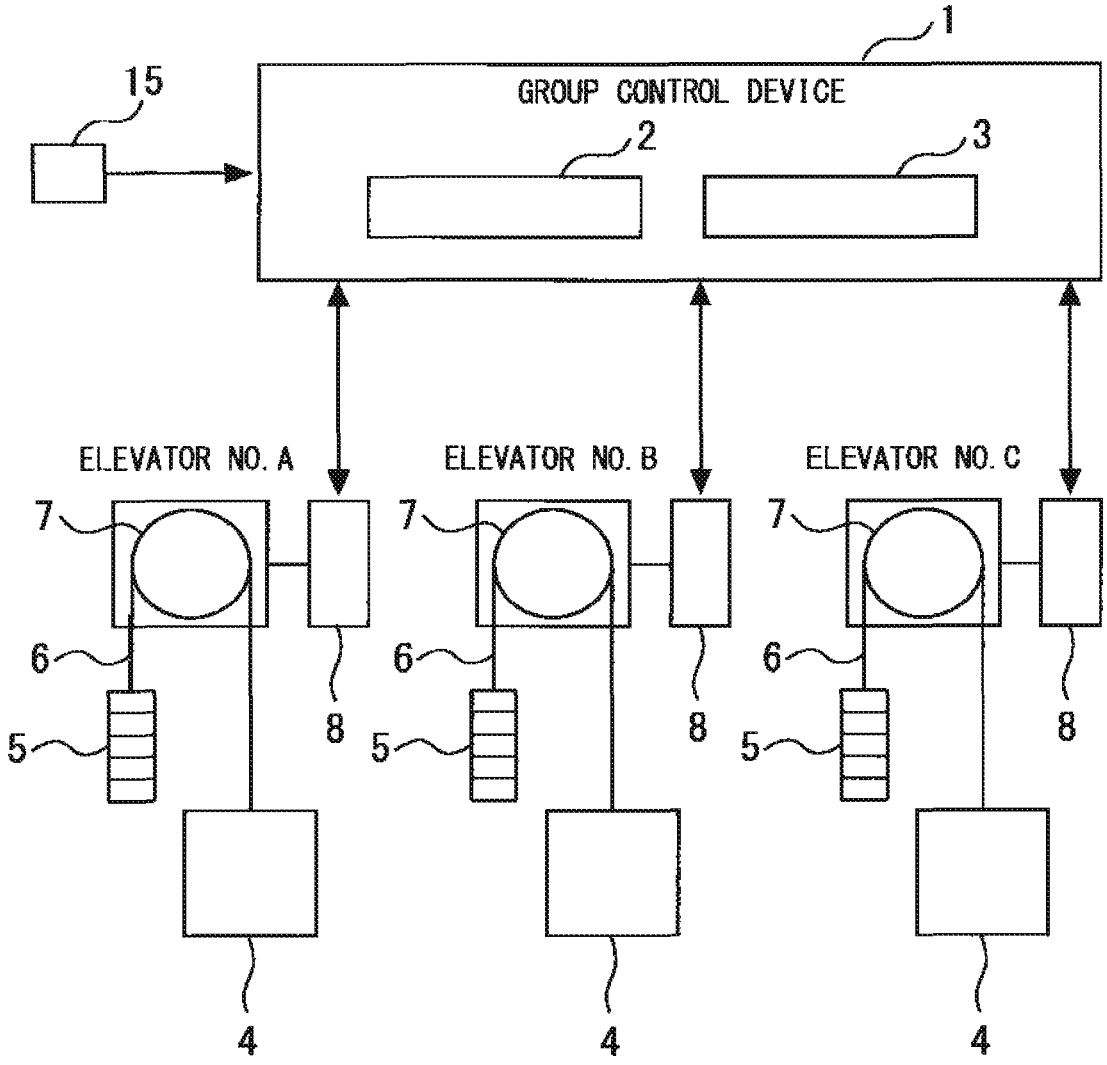
FIG. 1 is a diagram illustrating a structural example of an elevator system according to a first embodiment of the present invention.

The present invention will be described with reference to the accompanying drawings. Redundant descriptions will be simplified or omitted as appropriate. In each of the drawings, the same reference numerals denote the same or corresponding parts.

First Embodiment

FIG. 1 is a diagram illustrating a structural example of an elevator system according to a first embodiment of the present invention. A group control device 1 controls a plurality of elevator apparatuses installed in a building or the like as a group. FIG. 1 illustrates an example in which the group control device 1 controls three elevator apparatuses of an elevator No. A, an elevator No. B, and an elevator No. C. The group control device 1 may control two elevator apparatuses, or may control four or more elevator apparatuses. When a specific elevator apparatus is described below, "A", "B", or "C" is added after each reference numeral. For example, "A" is added after a reference numeral denoting an elevator No. A; "B" is added after a reference numeral denoting an elevator No. B; and "C" is added after a reference numeral denoting an elevator No. C. The group control device 1 includes, for example, an operation instruction unit 2 and a car position detecting unit 3.

Each elevator apparatus includes, for example, a car 4 and a counterweight 5. The car 4 moves vertically in a shaft. The shaft is, for example, a space that is formed in a building and extends vertically. The counterweight 5 moves vertically in the shaft. The car 4 and the counterweight 5 are suspended in the shaft by a main rope 6. A roping method for suspending the car 4 and the counterweight 5 is not limited to the example illustrated in FIG. 1.

The main rope 6 is wound around a driving sheave 7 of a traction machine. A control device 8 controls the rotation and stopping of the driving sheave 7. When the driving sheave 7 rotates, the main rope 6 moves in a direction corresponding to the direction in which the driving sheave 7 rotates. The car 4 ascends or descends in the direction in which the main rope 6 moves. The counterweight 5 moves in a direction opposite to the direction in which the car 4 moves.

A range in which a car 4A of the elevator No. A moves is adjacent to a range in which a car 4B of the elevator No. B moves. In other words, the car 4B can be positioned so as to be adjacent to the car 4A at the same height as the car 4A. For example, the car 4A stops at first to tenth floors of the building. The car 4B stops at first to tenth floors of the building. The range in which the car 4B moves need not completely match the range in which the car 4A moves.

The range in which the car 4B moves is adjacent to a range in which a car 4C of the elevator No. C moves. In other words, the car 4C can be positioned so as to be adjacent to the car 4B at the same height as the car 4B. For example, the car 4C stops at first to tenth floors of the building. The range in which the car 4C moves need not completely match the range in which the car 4B moves.

Figure 2:
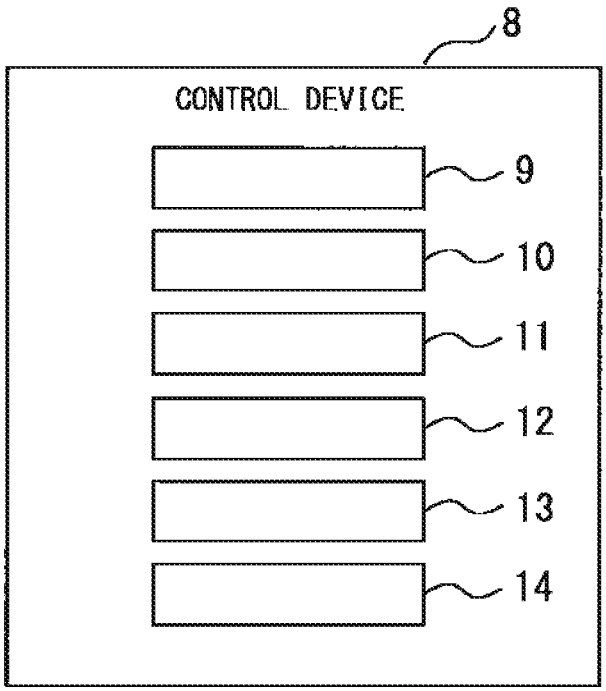
FIG. 2 is a diagram illustrating an example of a control device.
Figure 3:
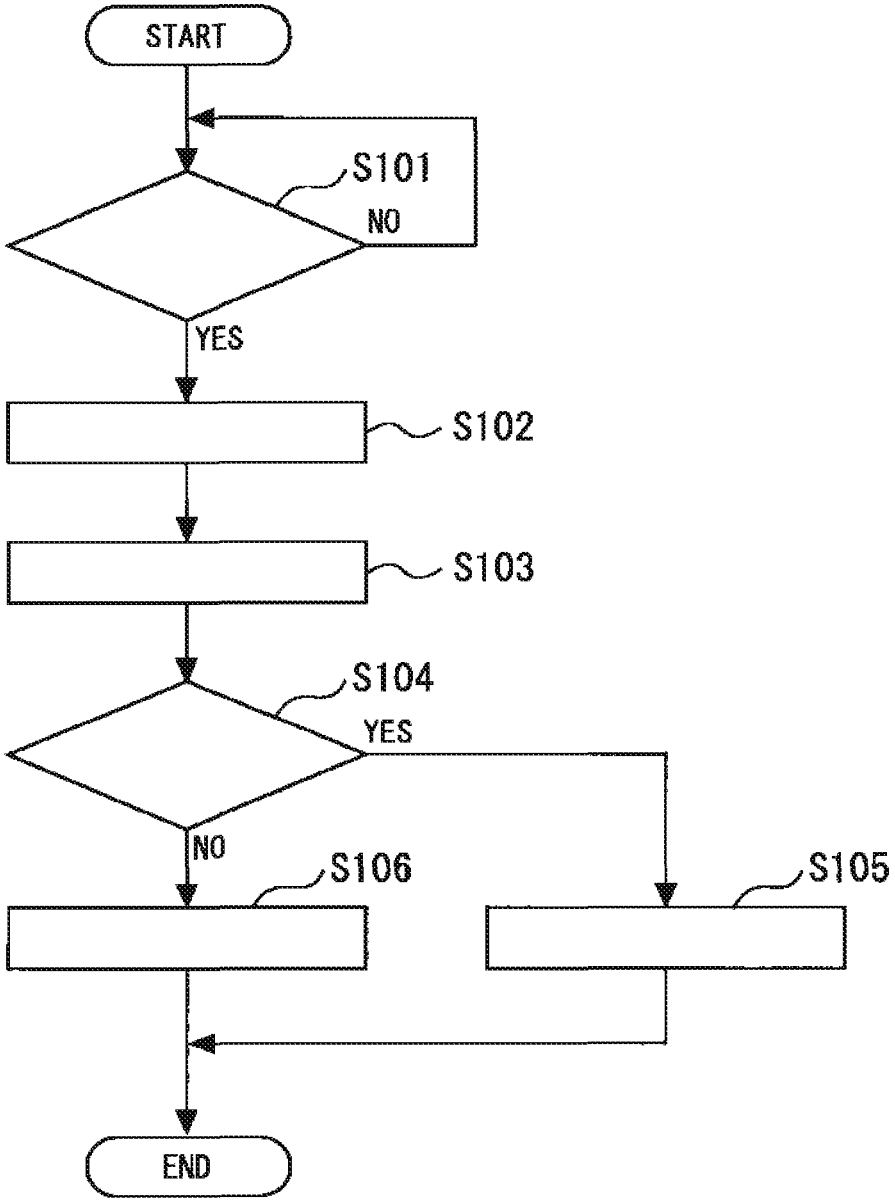
FIG. 3 is a flowchart illustrating a motion example of the elevator system according to the first embodiment of the present invention.

FIG. 2 is a diagram illustrating an example of the control device 8. The control device 8 includes, for example, a storage unit 9, an operation control unit 10, an emergency operation control unit 11, a diagnosis operation control unit 12, a learning operation control unit 13, and a setting unit 14. A motion to be performed when an earthquake occurs will be described in detail below with reference to FIG. 3. FIG. 3 is a flowchart illustrating a motion example of the elevator system according to the first embodiment of the present invention.

In the group control device 1, it is periodically determined whether or not an earthquake has occurred (S101). When no earthquake has occurred, a normal operation is performed in each elevator apparatus. The normal operation is an operation for carrying a user to his or her destination floor. The normal operation is controlled by the operation control unit 10. An operation control unit 10A moves the car 4A to perform the normal operation. An operation control unit 10B moves the car 4B to perform the normal operation. An operation control unit 10C moves the car 4C to perform the normal operation. The operation control unit 10 moves the car 4 at a rated speed in the normal operation. The operation control unit 10 causes, for example, the car 4 to sequentially respond to registered calls.

The occurrence of an earthquake is detected by a seismic detector 15. The seismic detector 15 is provided in, for example, the building in which the elevator apparatuses are installed. Upon detecting the occurrence of an earthquake, the seismic detector 15 transmits earthquake information to the group control device 1. When the group control device 1 receives the earthquake information from the seismic detector 15, the operation instruction unit 2 transmits an emergency operation instruction to each control device 8.

In each elevator apparatus, upon receiving the emergency operation instruction from the group control device 1, an earthquake emergency operation is started (S102). The earthquake emergency operation is an operation for causing people in the car 4 to evacuate to the outside of the car 4. The earthquake emergency operation is controlled by the emergency operation control unit 11. An emergency operation control unit 11A moves the car 4A to perform the earthquake emergency operation. An emergency operation control unit 11B moves the car 4B to perform the earthquake emergency operation. An emergency operation control unit 11C moves the car 4C to perform the earthquake emergency operation. Upon receiving the emergency operation instruction from the group control device 1, the emergency operation control unit 11 causes, for example, the car 4 to stop at a closest floor and open a door. After a lapse of a certain period of time after the car stops at the closest floor and opens the door, the emergency operation control unit 11 closes the door and causes the car 4 to stop at the closest floor.

When the earthquake emergency operation is completed, each elevator apparatus starts the diagnosis operation (S103). The diagnosis operation is an operation for automatically recovering to the normal operation after the occurrence of an earthquake. The diagnosis operation is controlled by the diagnosis operation control unit 12. A diagnosis operation control unit 12A moves the car 4A to perform the diagnosis operation. A diagnosis operation control unit 12B moves the car 4B to perform the diagnosis operation. A diagnosis operation control unit 12C moves the car 4C to perform the diagnosis operation.

The diagnosis operation control unit 12 causes predetermined various motions to be performed in the diagnosis operation. For example, the diagnosis operation control unit 12 moves the car 4 in a predetermined manner. In the diagnosis operation, various pieces of data are acquired. For example, torque data about the traction machine is acquired. The acquired data is compared with a reference range. The reference range is preliminarily stored in the storage unit 9. When the acquired data is not within the reference range, an abnormality is detected (Yes in S104).

When an abnormality is detected, the diagnosis operation control unit 12 stops the diagnosis operation (S105). When the diagnosis operation is stopped due to the detection of an abnormality, the elevator apparatus is manually recovered to the normal operation by a professional engineer. On the other hand, when the diagnosis operation is completed without detecting an abnormality (No in S104), the elevator apparatus is automatically recovered to the normal operation (S106).

Figure 4:
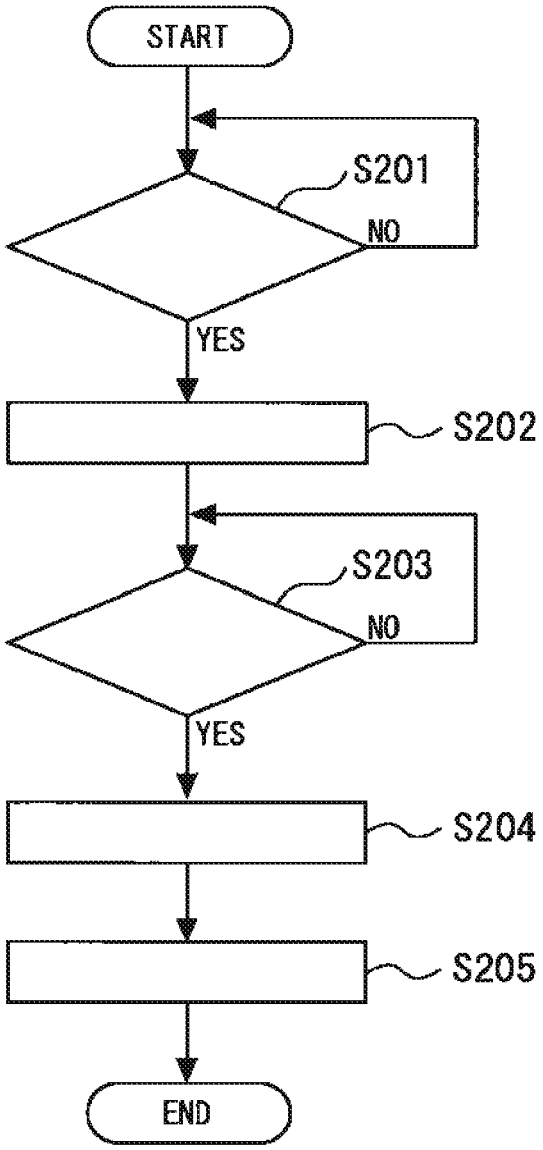
FIG. 4 is a flowchart illustrating another motion example of the elevator system according to the first embodiment of the present invention.
Figure 5:
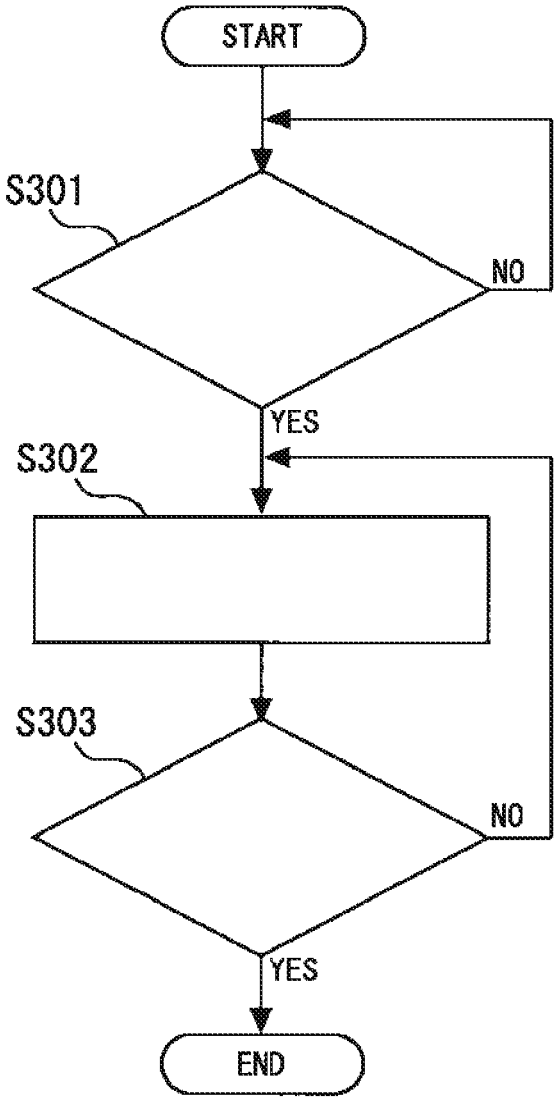
FIG. 5 is a flowchart illustrating another motion example of the elevator system according to the first embodiment of the present invention.

Next, a motion for setting the reference range will be described in detail with reference to FIGS. 4 and 5. FIGS. 4 and 5 are flowcharts illustrating another motion example of the elevator system according to the first embodiment of the present invention.

Each elevator apparatus periodically determines whether or not a start condition for starting the learning operation is satisfied (S201). The start condition is preliminarily stored in the storage unit 9. When the start condition not satisfied, the normal operation is performed in each elevator apparatus.

When the start condition is satisfied, each elevator apparatus starts the learning operation (S202). The learning operation is an operation for acquiring learning data necessary for setting the reference range. The learning operation is controlled by the learning operation control unit 13. A learning operation control unit 13A moves the car 4A to perform the learning operation. A learning operation control unit 13B moves the car 4B to perform the learning operation. A learning operation control unit 13C moves the car 4C to perform the learning operation.

When the elevator No. A, the elevator No. B, and the elevator No. C simultaneously start the learning operation, the operation efficiency in the entire system deteriorates. Accordingly, for example, when the elevator No. A is performing the learning operation, the elevator No. B and the elevator No. C may not perform the learning operation. An example in which the elevator No. A performs the learning operation will be described below. When the start condition is satisfied, the learning operation control unit 13A starts the learning operation. The learning operation control unit 13A moves the car 4A to acquire learning data necessary for setting the reference range.

Further, each elevator apparatus periodically determines whether or not the start condition is satisfied in the adjacent elevator apparatus (S301). When the start condition is satisfied in the adjacent elevator apparatus, the operation control unit 10 stops the control target car 4 at a predetermined position before the learning operation is started in the adjacent elevator apparatus. At this time, the operation control unit 10 stops the control target car 4 at a position outside of the range in which the car 4 of the adjacent elevator apparatus moves in the learning operation. After that, the operation control unit 10 controls the position of the control target car 4 so as not to be positioned at the same height as the car 4 which is performing the learning operation (S302).

For example, assume a case where the start condition for the elevator No. A is satisfied in S201. The car 4A of the elevator No. A moves from the first floor to the tenth floor in the learning operation. The operation control unit 10B of the elevator No. B causes the car 4B to stop at, for example, a position that is lower than the stop position on the first floor, before the learning operation is started in the elevator No. A. After that, the elevator No. B determines whether or not the learning operation is completed in the elevator No. A (S303). The operation control unit 10B controls the position of the car 4B so as not to be positioned at the same height as the car 4A until the learning operation is completed in the elevator No. A. For example, the operation control unit 10B controls the operation for carrying a user to his or her destination floor on condition that the car 4B is not positioned at the same height as the car 4A.

Predetermined various motions are performed by the learning operation control unit 13A in the elevator No. A, which has started the learning operation. For example, the learning operation control unit 13A moves the car 4A in a predetermined manner. In the learning operation, various pieces of learning data are acquired. For example, torque data about the traction machine is acquired as one piece of the learning data.

The learning operation control unit 13 performs predetermined various motions, thereby completing the learning operation (Yes in S203). When the learning operation is completed, the learning data acquired in the learning operation is stored in the storage unit 9 (S204).

When the learning operation is completed, the setting unit 14 sets the reference range for detecting an abnormality in the diagnosis operation (S205). The setting unit 14 sets the reference range on the basis of the learning data acquired in the learning operation. For example, the setting unit 14 sets, as the reference range, a certain range in which the learning data acquired in the learning operation is used as a central value. Information for setting an upper limit and a lower limit of the reference range is preliminarily stored in the storage unit 9.

In the elevator system described above, when the learning operation is performed in a specified elevator apparatus, the car 4 of the elevator apparatus that is adjacent to the specified elevator apparatus is controlled so as not to be positioned at the same height as the car 4 which is performing the learning operation. The car 4 which is performing the learning operation does not go by or overtake the car 4 of the adjacent elevator apparatus during the learning operation. Accordingly, a local variation due to a wind pressure or the like can be prevented from occurring in the learning data. In the elevator system, the reference range for detecting an abnormality in the diagnosis operation can be appropriately set.

Second Embodiment

The first embodiment illustrates an example in which, when a learning operation is performed in a specified elevator apparatus, the car 4 of the adjacent elevator apparatus is not positioned at the same height as the car 4 which is performing the learning operation. A local variation in learning data occurs due to a wind pressure, for example, when the adjacent car 4 goes by. This embodiment illustrates an example in which the object is achieved by reducing the above-mentioned wind pressure.

Figure 6:
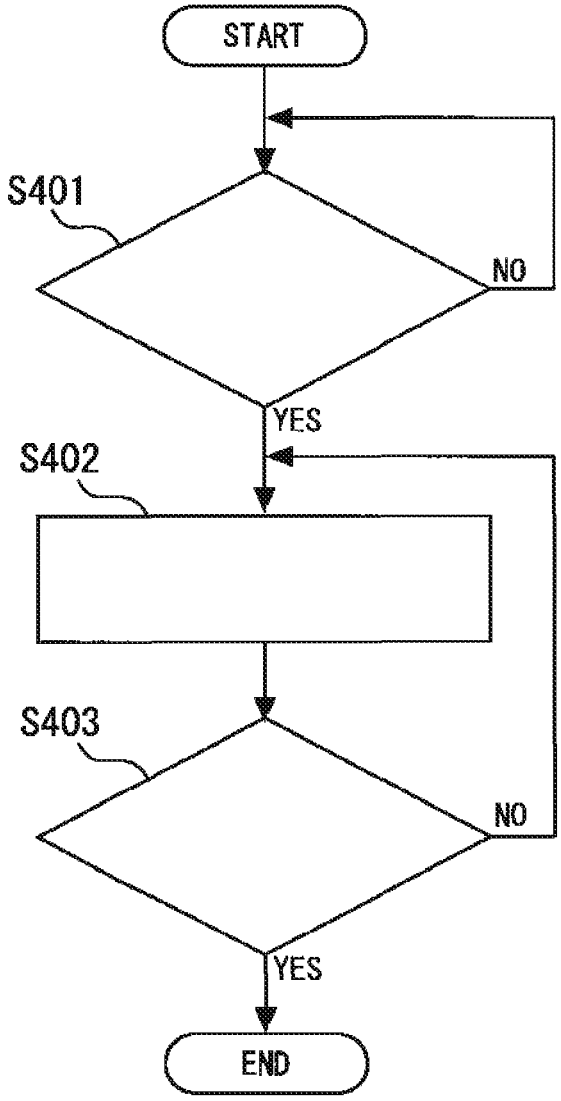
FIG. 6 is a flowchart illustrating a motion example of the elevator system according to a second embodiment of the present invention.

The configuration of the elevator system according to this embodiment is the same as the configuration disclosed in the first embodiment. A motion to be performed when an earthquake occurs is the same as the motion disclosed in the first embodiment. Also in this embodiment, the motion illustrated in FIG. 3 is performed when an earthquake occurs. A motion for setting a reference range will be described in detail below with reference to FIG. 6. FIG. 6 is a flowchart illustrating a motion example of the elevator system according to a second embodiment of the present invention.

Also in this embodiment, each elevator apparatus performs the motion illustrated in FIG. 4. Further, each elevator apparatus periodically determines whether or not the start condition for starting the learning operation in the adjacent elevator apparatus is satisfied (S401). When the learning operation is started in the adjacent elevator apparatus, the operation control unit 10 stops the control target car 4 in accordance with the position of the car 4 of the elevator apparatus which is performing the learning operation. Specifically, when the control target car 4 is positioned at the same height as the car 4 which is performing the learning operation, the operation control unit 10 stops the control target car 4 (S402). The car position detecting unit 3 detects the position of each car 4 group-controlled by the group control device 1. The operation control unit 10 determines whether or not the control target car 4 is positioned at the same height as the car 4 which is performing the learning operation, on the basis of the positions detected by the car position detecting unit 3.

For example, in S201, assume a case where the start condition for the elevator No. A is satisfied. When the learning operation is performed in the elevator No. A, the operation control unit 10B of the elevator No. B causes the car 4B to stop when the car 4B is positioned at the same height as the car 4A. Specifically, when the car 4A goes by the car 4B, the car 4B constantly stops. After that, the elevator No. B determines whether or not the learning operation in the elevator No. A is completed (S403). The operation control unit 10B performs the above-mentioned stop control for the car 4B until the learning operation in the elevator No. A is completed. For example, the operation control unit 10B controls the operation for carrying a user to his or her destination floor on condition that the car 4B constantly stops when the car 4B is positioned at the same height as the car 4A.

In the elevator system described above, when the learning operation is performed in a specified elevator apparatus, a motion is controlled such that the car 4 of the elevator apparatus that is adjacent to the specified elevator apparatus is stopped when the car 4 which is performing the learning operation goes by the adjacent car 4. The car 4 of the adjacent elevator apparatus does not rapidly move in proximity to the car 4 which is performing the learning operation. Thus, a local variation due to a wind pressure or the like can be prevented from occurring in the learning data. In the elevator system, the reference range for detecting an abnormality in the diagnosis operation can be appropriately set.

Figure 7:
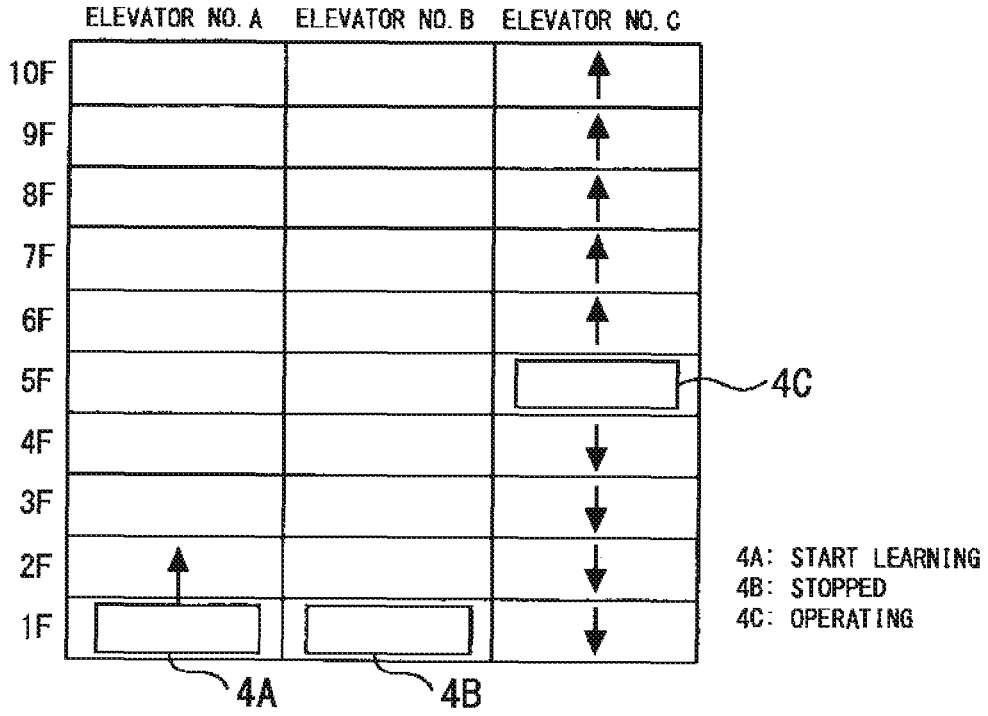
FIG. 7 is a diagram for explaining another motion example of the elevator system according to the second embodiment of the present invention.
Figure 8:
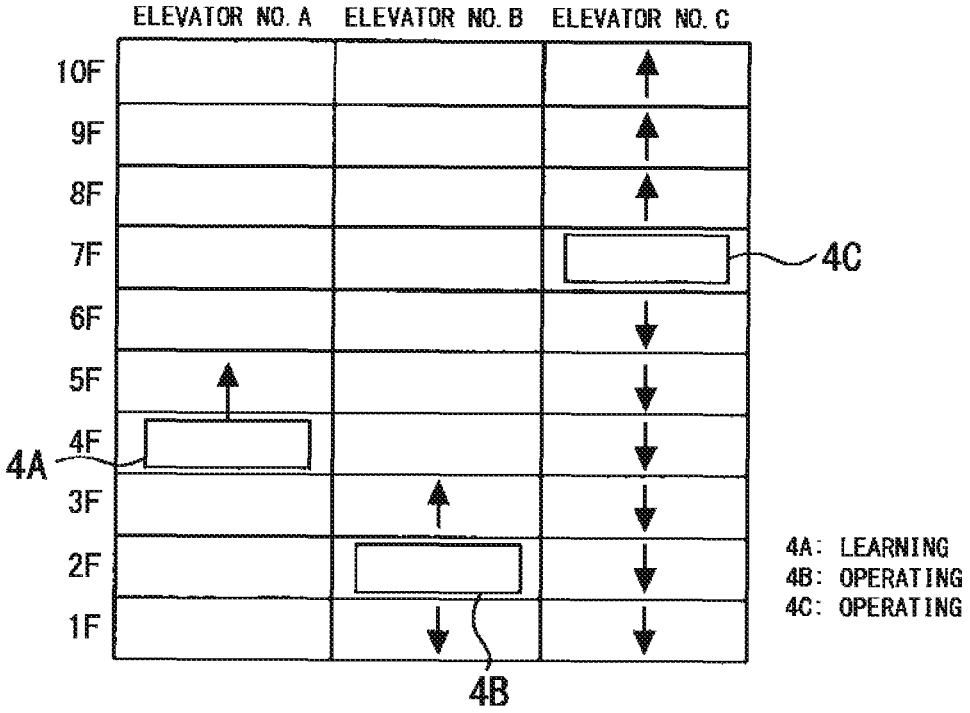
FIG. 8 is a diagram for explaining another motion example of the elevator system according to the second embodiment of the present invention.

FIGS. 7 and 8 are diagrams for explaining another motion example of the elevator system according to the second embodiment of the present invention. FIGS. 7 and 8 illustrate an example in which the start condition for the elevator No. A is satisfied in S201. When the learning operation is performed in the elevator No. A, the operation control unit 10B causes the car 4B to be positioned at the same height as the car 4A only when the learning operation is started as illustrated in FIGS. 7 and 8.

For example, when the start condition for the elevator No. A is satisfied, the operation control unit 10B causes the car 4B to stop at the stop position on the first floor before the learning operation is started in the elevator No. A. The stop position on the first floor is a position where the car 4A stops when the learning operation is started in the elevator No. A. For example, the car 4A moves from the first floor to the tenth floor in the learning operation. After the learning operation is started in, the elevator No. A, the operation control unit 10B controls the position of the car 4B so as not to be positioned at the same height as the car 4A which is performing the learning operation. For example, the operation control unit 10B controls the operation for carrying a user to his or her destination floor on condition that the car 4B is not positioned at the same height as the car 4A after the learning operation is started in the elevator No. A and the car 4A has left the first floor.

In the elevator system described above, the car 4 which is performing the learning operation can be prevented from being positioned at the same height as the car 4 of the adjacent elevator apparatus as much as possible. A similar effect can be achieved also when the car 4B is positioned at the same height as the car 4A only when the learning operation is ended. For example, the operation control unit 10B controls the position of the car 4B so as not to be positioned at the same height as the car 4A until just before the learning operation is ended after the learning operation is started in the elevator No. A. The operation control unit 10B causes the car 4B to stop at the stop position on the tenth floor immediately before the learning operation is ended in the elevator No. A. The stop position on the tenth floor is a position where the car 4A stops when the learning operation is ended in the elevator No. A. The operation control unit 10B may control the operation for carrying a user to his or her destination floor, for example, on condition that the car 4B is not positioned at the same height as the car 4A until just before the learning operation is ended after the learning operation is started in the elevator No. A.

Further, when, for example, the floor at which the car 4A stops when the learning operation is started matches the floor at which the car 4A stops when the learning operation is ended, the car 4B and the car 4A may be positioned at the same height only at the start and end of the learning operation.

This embodiment illustrates examples in which the wind pressure received by the car 4 during the learning operation is reduced by stopping the car 4 of the adjacent elevator apparatus. The wind pressure received by the car 4 during the learning operation can be reduced also when the car 4 of the adjacent elevator apparatus is decelerated. Accordingly, when the learning operation is performed in the adjacent elevator apparatus, the operation control unit 10 may decelerate the control target car 4 in accordance with the position of the car 4 which is performing the learning operation. For example, when the control target car 4 being moved is positioned at the same height as the car 4 which is performing the learning operation, the operation control unit 10 moves the car 4 at a speed lower than the rated speed. Also when such a function is applied, certain advantageous effects can be expected.

Third Embodiment

The first and second embodiments illustrate examples in which the object is achieved by the function of an elevator apparatus which is not performing the learning operation. This embodiment illustrates an example in which the object is achieved by the function of an elevator apparatus which is performing the learning operation.

Figure 9:
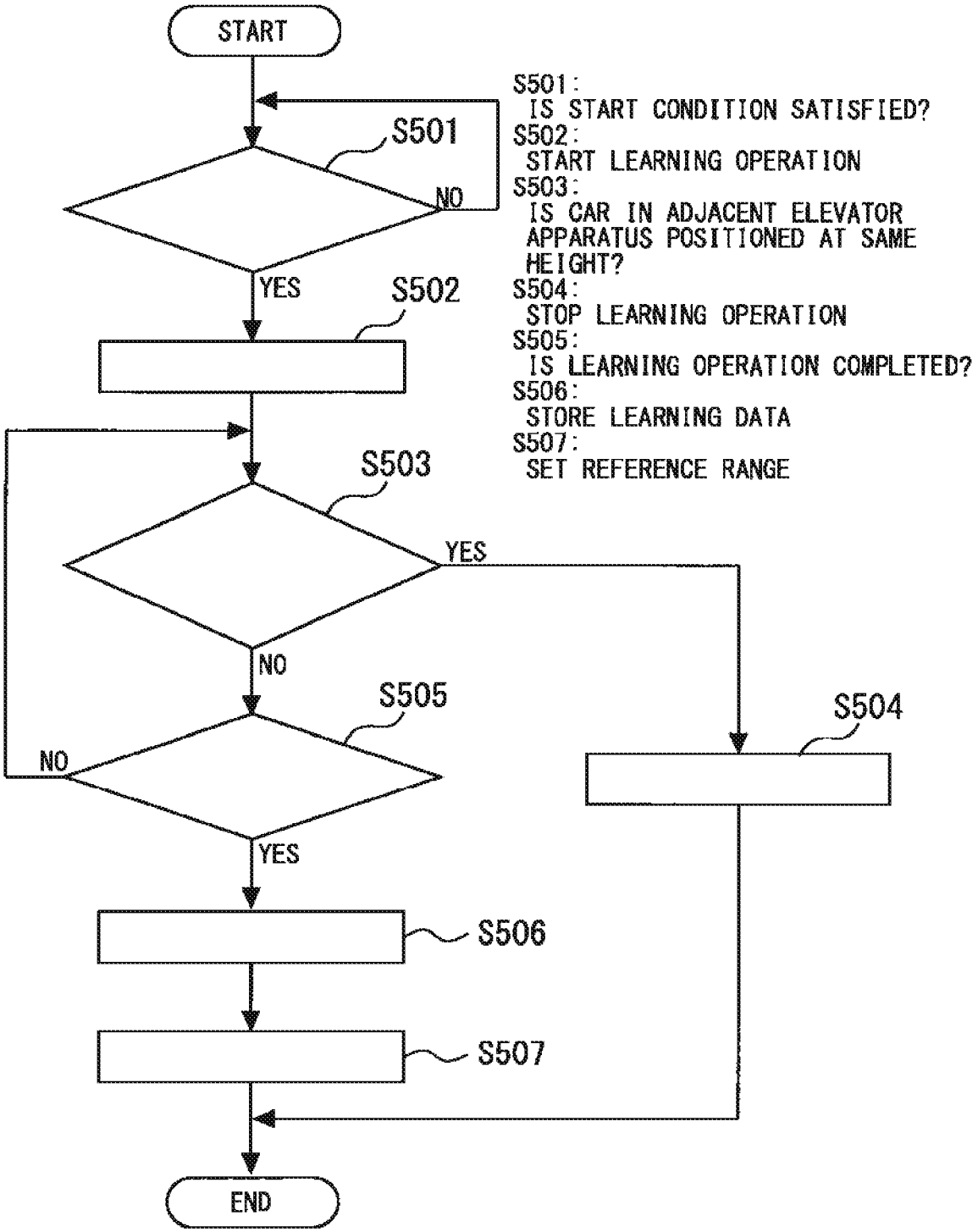
FIG. 9 is a flowchart illustrating a motion example of the elevator system according to a third embodiment of the present invention.

The configuration of the elevator system according to this embodiment is the same as the configuration disclosed in the first embodiment. A motion to be performed when an earthquake occurs is the same as the motion disclosed in the first embodiment. Also in this embodiment, when an earthquake occurs, the motion illustrated in FIG. 3 is performed. A motion for setting the reference range will be described in detail below with reference to FIG. 9. FIG. 9 is a flowchart illustrating a motion example of the elevator system according to a third embodiment of the present invention.

Each elevator apparatus periodically determines whether or not the start condition for starting the learning operation is satisfied (S501). When the start condition is not satisfied, each elevator apparatus performs the normal operation.

In each elevator apparatus, when the start condition is satisfied, the learning operation is started (S502). An example in which the elevator No. A performs the learning operation will be described below. When the start condition is satisfied, the learning operation control unit 13A starts the learning operation. The learning operation control unit 13A moves the car 4A to acquire learning data necessary for setting the reference range.

The elevator No. A which has started the learning operation determines whether or not the car 4B in the adjacent elevator No. B is positioned at the same height as the car 4A (S503). The learning operation control unit 13A determines whether or not the car 4B is positioned at the same height as the car 4A, for example, on the basis of the positions detected by the car position detecting unit 3. The learning operation control unit 13A stops the learning operation when the car 4B is positioned at the same height as the car 4A during the learning operation (S504).

The learning operation control unit 13 performs predetermined various motions, thereby completing the learning operation (Yes in S505). When the learning operation is completed, the learning data acquired in the learning operation is stored in the storage unit 9 (S506).

When the learning operation is completed, the setting unit 14 sets the reference range for detecting an abnormality in the diagnosis operation (S507). The setting unit 14 sets the reference range on the basis of the learning data acquired in the learning operation. For example, the setting unit 14 sets, as the reference range, a certain range in which the learning data acquired in the learning operation is used as a central value. Information for setting an upper limit and a lower limit of the reference range is preliminarily stored in the storage unit 9.

In the elevator system described above, when the car 4 of the elevator apparatus which is performing the learning operation is positioned at the same height as the car 4 of the adjacent elevator apparatus, the learning operation is stopped. Thus, the occurrence of a local variation due to a wind pressure or the like in the learning data can be prevented. In the elevator system, the reference range for detecting an abnormality in the diagnosis operation can be appropriately set.

Note that when the car 4 of the adjacent elevator apparatus is stopped, the wind pressure received by the car 4 which is performing the learning operation can be suppressed. Accordingly, in S503 illustrated in FIG. 9, it may be determined whether or not the car 4 of the adjacent elevator apparatus is positioned at the same height as the control target car 4, on condition that the car 4 of the adjacent elevator apparatus is moving. For example, the learning operation control unit 13A stops the learning operation when the car 4B being moved is positioned at the same height as the car 4A during the learning operation (S504). The learning operation control unit 13A does not stop the learning operation even when the car 4B being stopped is positioned at the same height as the car 4A when the learning operation is performed (No in S503).

When the learning operation is stopped in S504, the learning operation control unit 13 may perform the learning operation thereafter from the beginning, or may resume the learning operation at the car position where the learning operation is stopped, or in the vicinity of the car position.

In this embodiment, the elevator apparatus adjacent to the elevator apparatus which is performing the learning operation may perform any operation. For example, when the learning operation is performed in the elevator No. A, the operation control unit 10B controls the operation for carrying a user to his or her destination floor on condition that the car 4B is prevented from being positioned at the same height as the car 4A as much as possible. For example, the operation control unit 10B controls the position of the car 4B so as not to be positioned at the same height as the car 4A when the registered number of calls is equal to or less than a certain number. The operation control unit 10B performs an operation in which the car 4B can be positioned at the same height as the car 4A only when the registered number of calls exceeds the certain number.

Fourth Embodiment

In this embodiment, an example in which the object is achieved by the function of the setting unit 14 of the control device 8. The configuration of the elevator system according to this embodiment is the same as the configuration disclosed in the first embodiment. A motion to be performed when an earthquake occurs is the same as the motion disclosed in the first embodiment. Also in this embodiment, the motion illustrated in FIG. 3 is performed when an earthquake occurs.

Figure 10:
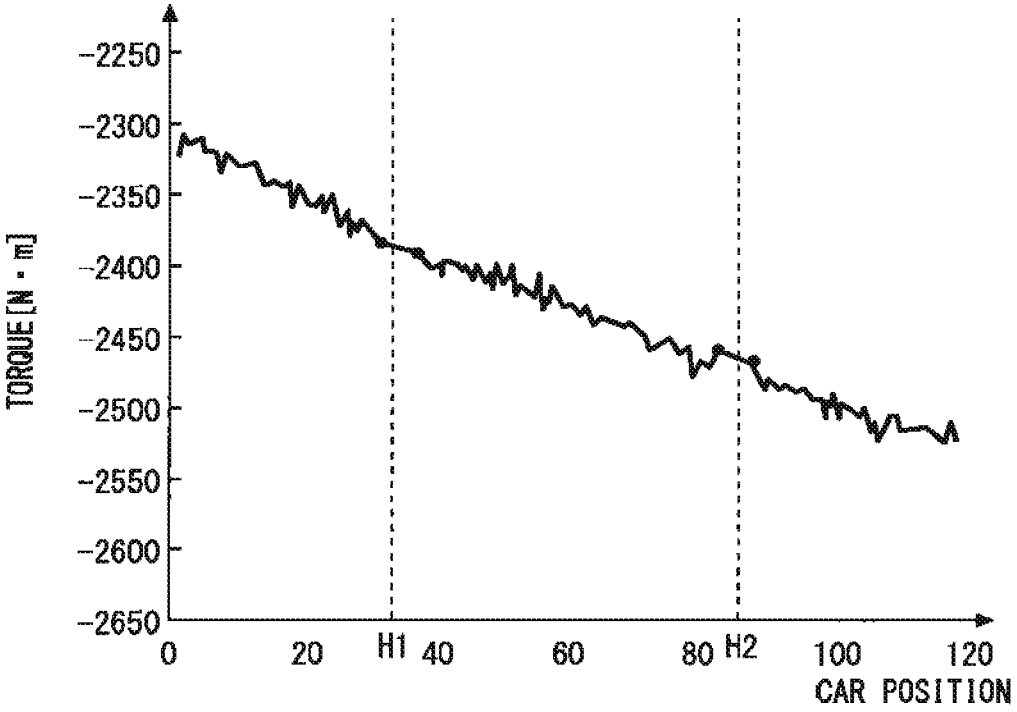
FIG. 10 is a diagram for explaining an example of a reference range setting function of the control device.

A motion for setting the reference range will be described in detail below with reference to FIG. 10. FIG. 10 is a diagram for explaining an example of a reference range setting function of the control device 8.

Also in this embodiment, each elevator apparatus performs the motion shown in FIG. 4. An example in which the learning operation is performed in the elevator No. A will be described below. The learning operation control unit 13A starts the learning operation when the start condition is satisfied. The learning operation control unit 13A moves the car 4A to acquire learning data necessary for setting the reference range. When the learning operation is completed, the learning data acquired in the learning operation is stored in the storage unit 9A.

The setting unit 14A sets the reference range on the basis of the learning data acquired in the learning operation. For example, when the reference range is set, the setting unit 14A does not use learning data acquired when the car 4B of the adjacent elevator No. B is positioned at the same height as the car 4A among the learning data acquired in the learning operation. FIG. 10 illustrates an example in which the car 4B is positioned at the same height as the car 4A at car positions H1 and H2. For example, the setting unit 14A discards learning data acquired when the car 4B is positioned at the same height as the car 4A. The setting unit 14A sets the reference range by performing a linear interpolation on the discarded part of the learning data.

A method for interpolating the discarded part of the learning data is not limited to the above-mentioned example. For example, the learning data corresponding to the discarded part may be obtained by performing the learning operation a plurality of times. The setting unit 14A may interpolate the discarded part of the learning data on the basis of the learning data acquired before (e.g., previous time). The setting unit 14A may interpolate the discarded part of the learning data on the basis of an average value of a plurality of pieces of learning data acquired before. Further, the learning data may be displayed clearly enough for a maintenance personnel to see the discarded part, and the discarded part may be manually interpolated by the maintenance personnel.

Figure 11:
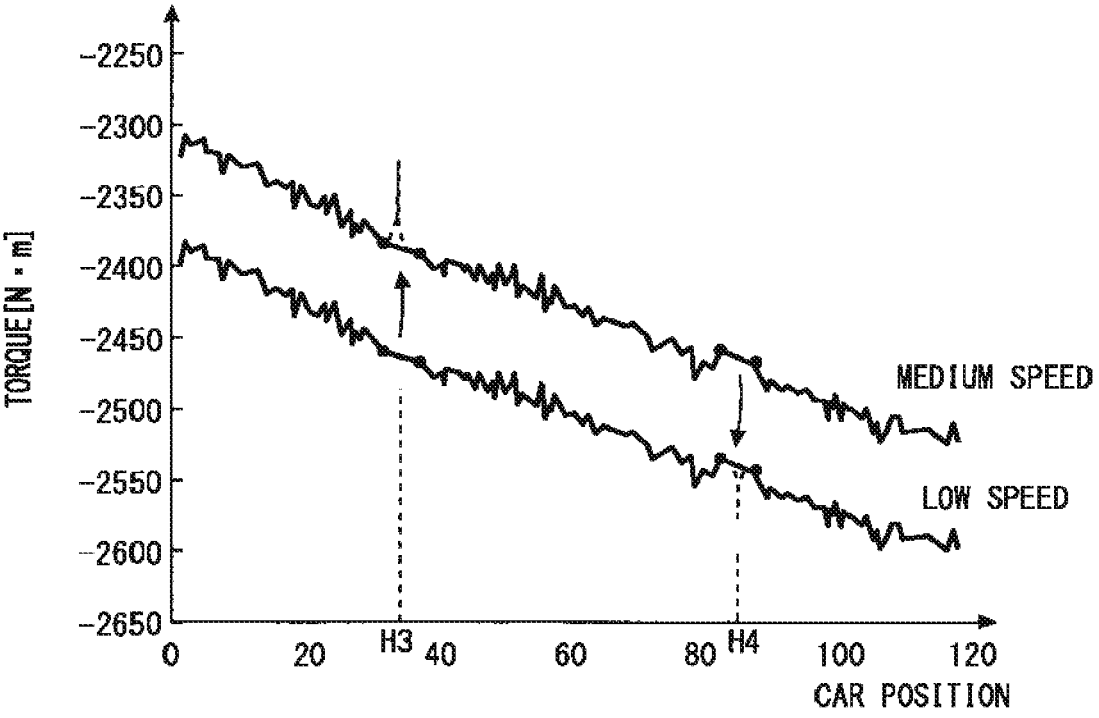
FIG. 11 is a diagram for explaining another example of the reference range setting function of the control device.

FIG. 11 is a diagram for explaining another example of the reference range setting function of the control device 8. The learning operation is performed, for example, at a low speed that is lower than the rated speed, and at a medium speed that is lower than the rated speed and higher than the low speed. FIG. 11 illustrates an example in which the car 4B is positioned at the same height as the car 4A at a car position indicated by H4 in the learning operation performed at the low speed. Further, FIG. 11 illustrates an example in which the car 4B is positioned at the same height as the car 4A at a car position indicated by H3 in the learning operation performed at the medium speed.

The setting unit 14A discards learning data acquired, for example, when the car 4B is positioned at the same height as the car 4A. The setting unit 14A interpolates the learning data acquired in the learning operation at the low speed on the basis of the learning data acquired in the learning operation at the medium speed. Further, the setting unit 14A interpolates the learning data acquired in the learning operation at the medium speed on the basis of the learning data acquired in the learning operation at the low speed.

In the elevator system described above, the reference range for detecting an abnormality in the diagnosis operation can be appropriately set.

Note that when the car 4 of the adjacent elevator apparatus is stopped, the wind pressure received by the car 4 which is performing the learning operation can be suppressed. Accordingly, the setting unit 14 may determine whether or not to use the learning data on condition that the car 4 of the adjacent elevator apparatus is moving. For example, the setting unit 14A sets the reference range without using learning data acquired when the car 4B being moved is positioned at the same height as the car 4A among the learning data acquired in the learning operation. Even if the learning data is acquired when the car 4B is positioned at the same height as the car 4A, the setting unit 14A sets the reference range by using the learning data, as long as the car 4B is stopped.

In this embodiment, the elevator apparatus adjacent to the elevator apparatus which is performing the learning operation may perform any operation. For example, when the elevator No. A is performing the learning operation, the operation control unit 10B controls the operation for carrying a user to his or her destination floor on condition that the car 4B is prevented from being positioned at the same height as the car 4A as much as possible. For example, when the registered number of calls is equal to or less than a certain number, the operation control unit 10B controls the position of the car 4B so as not to be positioned at the same height as the car 4A. The operation control unit 10B performs an operation in which the car 4B can be positioned at the same height as the car 4A, only when the registered number of calls exceed the certain number.

Figure 12:
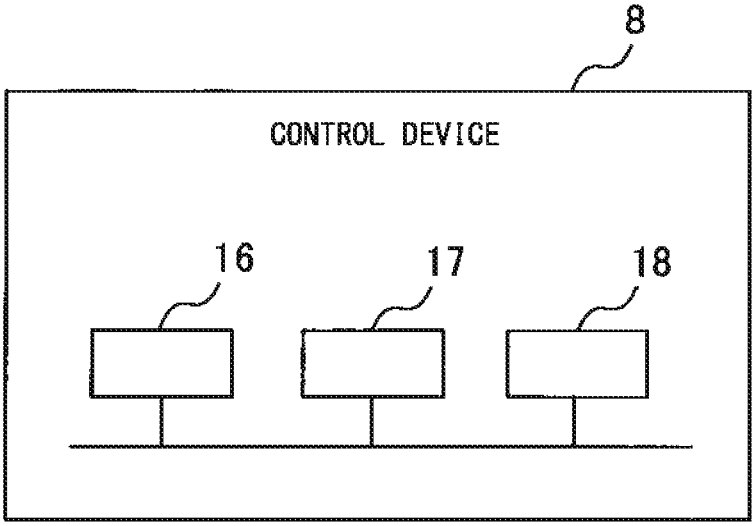
FIG. 12 is a diagram illustrating hardware components in the control device.
Figure 13:
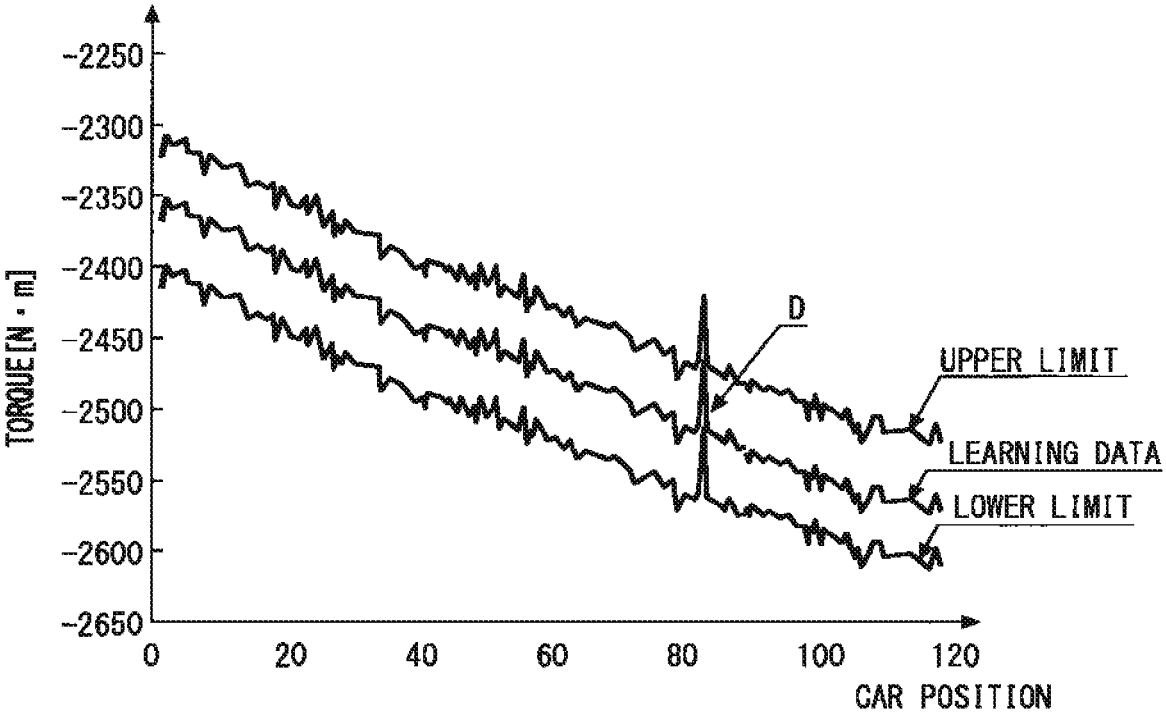
FIG. 13 is a diagram for explaining a problem with the related art.

In each embodiment, each of the units denoted by reference numerals 9 to 14 represents a function included in the control device 8. FIG. 12 is a diagram illustrating hardware components in the control device 8. Each control device 8 includes circuitry including, as hardware resources, for example, an input/output interface 16, a processor 17, and memory 18. The functions included in the storage unit 9 can be realized by the memory 18. The control device 8 realizes each function included in the units 10 to 14 by having the processor 17 execute a program stored in the memory 18.

Some or all of the functions included in the units 10 to 14 may be realized by hardware.

Each of the units denoted by reference numerals 2 and 3 represents a function included in the group control device 1. Hardware components in the group control device 1 is similar to the components illustrated in FIG. 12. Each control device 8 may include some or all of the functions included in the group control device 1.

INDUSTRIAL APPLICABILITY

An elevator system according to the present invention can be applied to a system that performs a diagnosis operation after the occurrence of an earthquake.

REFERENCE SIGNS LIST

1 group control device
2 operation instruction unit
3 car position detecting unit
4 car
5 counterweight
6 main rope
7 driving sheave
8 control device
9 storage unit
10 operation control unit
11 emergency operation control unit
12 diagnosis operation control unit
13 learning operation control unit
14 setting unit
15 seismic detector
16 input/output interface
17 processor
18 memory

The invention claimed is:

1. An elevator system comprising:
a first car that moves vertically;
a second car that moves vertically and is allowed to be positioned so as to be adjacent to the first car at the same height as the first car; and
circuitry
to move, after an occurrence of an earthquake, the first car to perform a diagnosis operation;
to move the first car to perform a learning operation;
to set a reference range for detecting an abnormality in the diagnosis operation on the basis of teaming data acquired in the learning operation;
to control a position of the second car so as not to be positioned at the same height as the first car during the learning operation.

2. An elevator system comprising:
a first car that moves vertically;
a second car that moves vertically and is allowed to be positioned so as to be adjacent to the first car at the same height as the first car; and
circuitry
to move, after an occurrence of an earthquake, the first car to perform a diagnosis operation;
to move the first car to perform a learning operation;
to set a reference range for detecting an abnormality in the diagnosis operation on the basis of learning data acquired in the learning operation;
to cause the second car to stop when the second car is positioned at the same height as the first car during the learning operation.

3. The elevator system according to claim 2, wherein the circuitry is configured to cause, during the learning operation, the second car to be positioned at the same height as the first car only when the learning operation is started.

4. The elevator system according to claim 2, wherein the circuitry is configured to cause, during the learning operation, the second car to be positioned at the same height as the first car only when the learning operation is ended.

5. The elevator system according to claim 2, wherein the circuitry is configured to cause, during the learning operation, the second car to be positioned at the same height as first car only when the learning operation is started and ended.

6. An elevator system comprising:
a first car that moves vertically;
a second car that move vertically and is allowed to be positioned so as to be adjacent to the first car at the same height as the first car; and
circuitry
to move, after an occurrence of an earthquake, the first car to perform a diagnosis operation;
to set a reference range for detecting an abnormality in the diagnosis operation on the basis of learning data acquired in the learning operation;
to move the second car at a first speed to perform a normal operation and;
to cause, during the learning operation, the second car to be moved at a second speed when the second car being moved is positioned at the same height as the first car, the second speed being lower than the first speed.

7. An elevator system comprising:
a first car that moves vertically;
a second car that moves vertically and is allowed to be positioned so as to be adjacent to the first car at the same height as the first car; and
circuitry
to move, after an occurrence of an earthquake, the first car to perform a diagnosis operation;
to move the first car to perform a learning operation;
to set a reference range for detecting an abnormality in the diagnosis operation on the basis of learning data acquired in the learning operation; and
to stop the learning operation when the second car is positioned at the same height as the first car during the learning operation.

8. The elevator system according to claim 7,
wherein the circuitry is configured to stop the learning operation when the second car being moved is positioned at the same height as the first car during the learning operation.

9. An elevator system comprising:
a first car that moves vertically;
a second car that moves vertically and is allowed to be positioned so as to be adjacent to the first car at the same height as the first car; and
circuitry
to move, after an occurrence of an earthquake, the first car to perform a diagnosis operation;
to move the first car to perform a learning operation;
to set a reference range for detecting an abnormality in the diagnosis operation on the basis of learning data acquired in the learning operation; and
to set the reference range without using learning data acquired when the second car is positioned at the same height as the first car among the learning data acquired in the learning operation.

10. The elevator system according to claim 9, wherein the circuitry is configured to set the reference range without using learning data acquired when the second car being moved is positioned at the same height as the first car among the learning data acquired in the learning operation.

* * * * *